US007743721B2

(12) United States Patent
Barrett et al.

(10) Patent No.: US 7,743,721 B2
(45) Date of Patent: Jun. 29, 2010

(54) CONTROL OF A WATERJET PROPELLED VESSEL

(75) Inventors: Andrew F. Barrett, Annapolis, MD (US); James R. Jefferson, Annapolis, MD (US)

(73) Assignee: Rolls-Royce Naval Marine, Inc., Walpole, MA (US)

( * ) Notice: Subject to any disclaimer, the term of this patent is extended or adjusted under 35 U.S.C. 154(b) by 532 days.

(21) Appl. No.: 10/581,123

(22) PCT Filed: Dec. 1, 2004

(86) PCT No.: PCT/US2004/039936

§ 371 (c)(1),
(2), (4) Date: Jun. 13, 2007

(87) PCT Pub. No.: WO2005/054050

PCT Pub. Date: Jun. 16, 2005

(65) Prior Publication Data

US 2008/0027597 A1 Jan. 31, 2008

Related U.S. Application Data

(60) Provisional application No. 60/525,888, filed on Dec. 1, 2003.

(51) Int. Cl.
*B63H 25/04* (2006.01)

(52) U.S. Cl. ..... 114/144 R; 114/144 A; 701/21

(58) Field of Classification Search ..... 114/144 A, 114/144 E, 144 R, 150, 151; 440/38, 53, 440/84, 87; 701/21
See application file for complete search history.

(56) References Cited

U.S. PATENT DOCUMENTS

| | | | | |
|---|---|---|---|---|
| 3,604,907 | A | 9/1971 | Wesner | |
| 3,715,571 | A | 2/1973 | Braddon | |
| 3,825,911 | A * | 7/1974 | Burns | 340/870.34 |
| 5,509,369 | A * | 4/1996 | Ford et al. | 114/150 |
| 5,632,217 | A * | 5/1997 | Ford et al. | 114/150 |
| 6,230,642 | B1 | 5/2001 | McKenney | |
| 6,273,771 | B1 | 8/2001 | Buckley | |

* cited by examiner

*Primary Examiner*—Lars A Olson
(74) *Attorney, Agent, or Firm*—Timothy J. Kilma; Shuttleworth & Ingersoll, PLC

(57) ABSTRACT

A method for controlling a watercraft includes acquiring a desired heading of the watercraft, acquiring an actual heading of the watercraft at time $T_0$, calculating a heading error by comparing the desired heading with the actual heading and determining a rate of change of the heading error. A P gain, I gain and D gain for use in maintaining the heading of the watercraft is determined and used to calculate factors related to heading error, cumulative heading error and rate of change of heading error. These factors are summed to form a control value for deflecting a nozzle of the watercraft to maintain a heading of the watercraft. Further embodiments include methods for calculating and correcting a heading of the watercraft, as well as methods for controlling roll out and sideways motion of the watercraft.

59 Claims, 7 Drawing Sheets

CONTROL OF A WATERJET PROPELLED VESSEL

This application is the National Phase of International Application PCT/US04/39936 filed Dec. 1, 2004 which designated the U.S. and that International Application was published under PCT Article 21(2) in English.

The present application claims priority to U.S. Provisional Patent Application 60/525,888, filed Dec. 1, 2003, the entirety of which is incorporated by reference herein.

BACKGROUND

The present invention relates to the control of a water jet propelled vessel. Such waterjet propelled vessels are known and can range in size from small personal watercraft to boats of up to 75 feet in length, or vessels of even larger size.

A waterjet-powered vessel is moved through the water by accelerating a stream of water through a nozzle, thereby moving the vessel in reaction to the accelerated stream of water. The nozzle can be fixed to the rear of the vessel and aimed to produce lateral forces on the vessel which are used to steer the vessel. The waterjet is either engaged and pumping water or not engaged and not pumping water. Multiple waterjets/nozzles can also be used. The nozzle at the rear of the vessel is also usually equipped with a reversing bucket which, when activated, redirects some or all of the nozzle flow to produce a reversed component of thrust on the vessel. A waterjet thruster can also be positioned in or near the bow of the vessel with its axis essentially perpendicular to the vessel's bow-stern axis to produce lateral forces at the bow of the vessel. Combined, the rear nozzle, reversing bucket and bow thruster can be used to simultaneously maneuver the watercraft in any desired direction or heading.

The vessel can be equipped with a multi-axis joystick that allows the operator to simultaneously control the nozzle angle, reverse bucket position, and bow thrusters. Forward and aft movement of the joystick activates the reverse bucket. Sideways movement of the joystick activates the bow thruster, and nozzle angle is controlled by a twisting movement of the joystick.

U.S. Pat. No. 6,234,100 to Fadeley, dated May 22, 2001, discloses a Stick Control System For Waterjet Boats and U.S. Pat. No. 6,230,642 to McKenney, dated May 15, 2001 discloses an Autopilot Based Steering And Maneuvering System For Boats. U.S. Patent Application No. 2003/0054707 to Morvillo, dated Mar. 20, 2003, discloses an Integral Reversing And Trim Deflector And Control Mechanism and U.S. Patent Application No. 2003/0079668 to Morvillo, dated May 1, 2003 discloses a Method And Apparatus For Controlling A Waterjet Driven Marine Vessel. These two patents and two patent applications are incorporated by reference herein.

Despite the degree of control offered by these maneuvering and steering control systems, there remains a need for a control system that improves control algorithms to provide a more predictable control system that is more intuitive to operate.

SUMMARY OF THE INVENTION

The present invention includes several embodiments for controlling a watercraft. A first embodiment includes acquiring a desired heading of the watercraft, acquiring an actual heading of the watercraft at time $T_0$, calculating a heading error by comparing the desired heading with the actual heading, determining a rate of change of the heading error and determining a P gain, I gain and D gain for use in maintaining the heading of the watercraft. Then, a $PtermT_0$, $ItermT_0$, and $DtermT_0$ are determined using the following equations:

$$PtermT_0 = P^* \text{Heading Error}$$

$$ItermT_0 = ItermT_{0-1} + (I^* \text{Heading Error}^* (T_0 - T_{0-1}))$$

$$DtermT_0 = D^* \text{Rate of Change of Heading Error}$$

wherein P, I and D are the determined P gain, I gain and D gain, respectively. A value for Control $OutT_0$ is then determined by summing the values for $PtermT_0$, $ItermT_0$, and $DtermT_0$ and then an amount of deflection for a nozzle of the watercraft is determined, for altering a heading of the watercraft, based on the value for Control $OutT_0$. The nozzle is deflected based on the determined amount of deflection and the $T_0$ to $T_{0+1}$ are reset with the steps being repeated until the actual heading equals the desired heading.

A second embodiment for calculating a heading of a watercraft includes acquiring a heading of the watercraft at a base time, acquiring a heading turn rate from an angular rate of turn sensor of the watercraft at a later time and determining whether the acquired heading is believed accurate at the later time. If the acquired heading is believed inaccurate, a heading of the watercraft is calculated by adding a factor for the heading turn rate to the acquired heading and the calculated heading output for control of the heading of the watercraft.

A further embodiment for correcting a heading of a watercraft, includes measuring an amount of error induced by the effect of at least one disturbance on at least one of x, y and z heading data from a heading sensor, acquiring at least one of x, y and z heading data from a heading sensor, determining whether the at least one disturbance is occurring, correcting the heading data in the occurrence of a disturbance by adding a factor to the heading that offsets the measured amount of error induced by the disturbance and outputting the corrected heading data for control of the heading of the watercraft.

A further embodiment for controlling roll out of a watercraft includes determining whether a nozzle control apparatus is off center to alter a position of a nozzle of the watercraft and if the nozzle control apparatus is off center, setting a nozzle control command to a nozzle control apparatus command, determining whether the nozzle control apparatus has been returned to a center position, determining a heading rate for the watercraft and if the nozzle control apparatus has been returned to a center position, setting a nozzle control command to a negative of the heading rate multiplied by a constant factor predetermined for the watercraft based on operating data of the watercraft.

A further embodiment for controlling a watercraft having a rear nozzle for propulsion and a bow thruster includes, during at least one of initiation and cessation of sideways movement of the watercraft, prepositioning an angle of the rear nozzle to provide a sideways force that minimizes vessel yaw prior to the occurrence of a heading error, the prepositioned angle based on the operating characteristics of the watercraft.

A further embodiment for controlling a watercraft having a rear nozzle for propulsion and a bow thruster includes initiating a sideways movement of the watercraft by engaging the rear nozzle while delaying engagement of the bow thruster and engaging the bow thruster after a first predetermined time delay to assist in the sideways movement of the watercraft after a stern of the watercraft has gained sideways momentum from the rear nozzle, the first predetermined time delay based on the operating characteristics of the watercraft to minimize yaw of the watercraft during the sideways movement.

A further embodiment for the control of a watercraft having a magnetic sensor for determining a heading of the watercraft includes reducing the effect of electro-magnetic field interference from electrical equipment of the watercraft on the accuracy of a heading signal from the magnetic sensor controlling use of the heading signal based on at least one of a function mode of the watercraft and a position of a vessel movement control apparatus by at least one of: compensating for the field interference and acquiring the heading signal only when electro-magnetic interference is sufficiently low to prevent substantive inaccuracy of the heading data.

DESCRIPTION OF THE INVENTION

The present invention includes several control methods for controlling the waterjet propelled vessel. These methods can be used individually or in combination with one or more of the other control methods to control the vessel. In the preferred embodiment, the control system will include several or all of the various control methods.

These control methods can be incorporated in the controller that controls activation of the nozzle, reversing bucket and bow thruster of the vessel and when used, will operate as described below, and can do this taking into account operator input, vessel movement data and other collected data or desired operating parameters. In all methods, alternate thrusting devices can also be used. The methods can be used with watercraft having one or more nozzle and reversing bucket sets, controllable in unison or independently.

Maintaining Heading of a Watercraft

One problem with current waterjet control systems of the type referenced above is their inability to effectively maintain heading. To be more commercially viable, the control system must give the operator the feeling that he or she is in complete control of the vessel. Overshooting turns and erratic or unstable straight-line performance do not give the operator the feeling of being in control.

In one control method of the invention, the control system maintains proper vessel heading at all speeds without operator intervention. To maintain the heading, the control method compares the desired heading to the actual heading and deflects the nozzle to correct the error. Regardless of vessel speed, including zero speed, the controller automatically maintains the vessel heading by simultaneously controlling all propulsors, including bow thrusters, and thrust vectoring devices such as waterjets.

Figure 1:
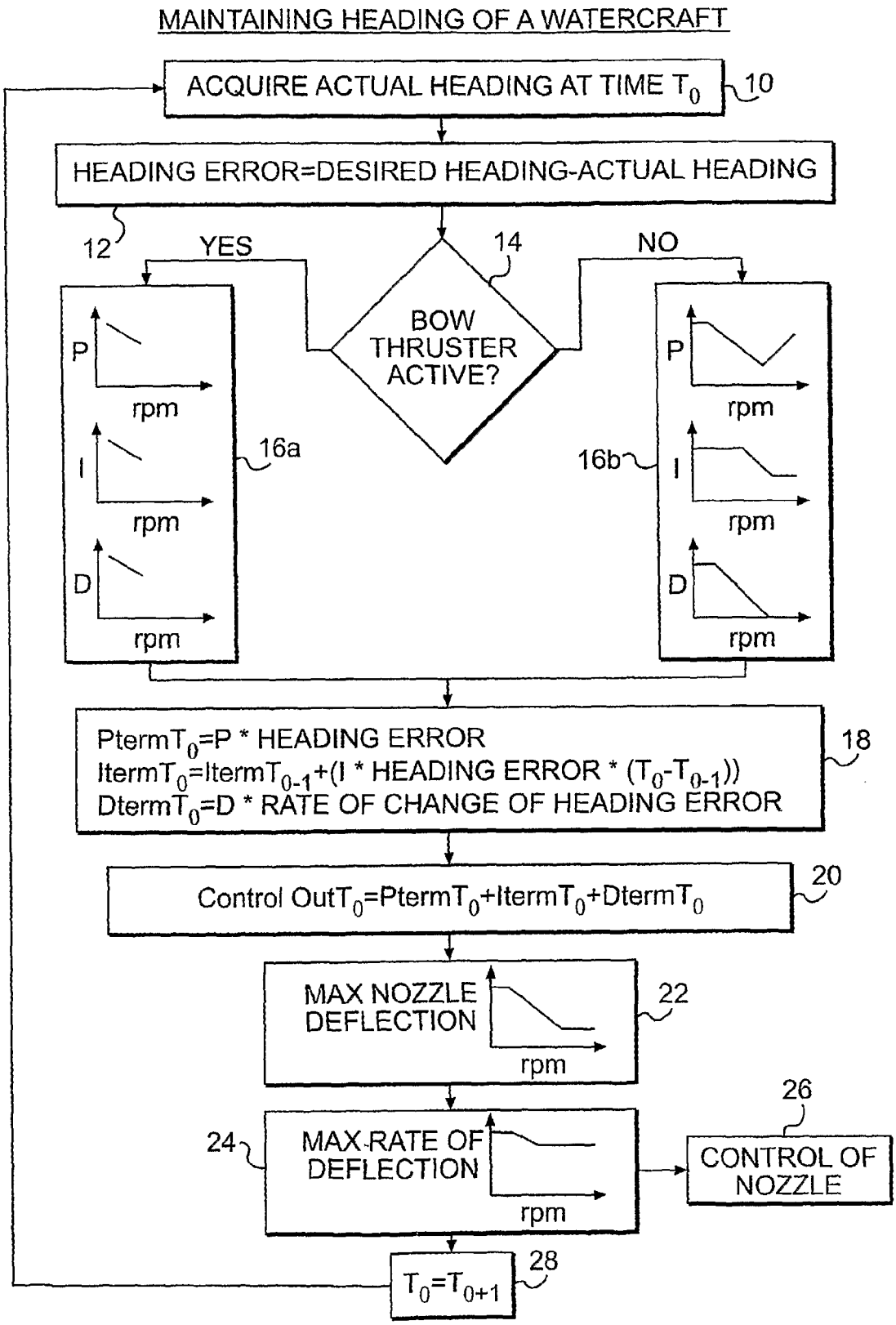
FIG. 1 is a logic flow chart for a first embodiment of the present invention.

See FIG. 1 for a logic flow chart of this control method. First, the desired heading is acquired. This can either be input into the system or captured by the system based on a heading at a specific acquisition time. Next, the actual heading is acquired at step 10. In a preferred embodiment, this is acquired from a three axis heading sensor hard-mounted to the vessel and connected to the electronic controller. The sensor has three axes, each of which uses a magneto-inductive sensor that measures the earth's magnetic field. Because the heading sensor is hard-mounted to the vessel and the vessel is subject to pitch and roll movements from waves, the signal from the heading sensor may be adversely affected. To correct this condition, a pitch and roll sensor mounted to the vessel can be used to measure pitch and roll and provide a signal indicating the pitch and roll to the controller to enable correction of the heading signal. Other types of heading sensors can also be used.

Once the actual heading is acquired, whether from a magnetic sensor or not, the heading error is calculated at step 12 by subtracting the actual heading from the desired heading. Since the vessel dynamics are different depending on whether the bow thruster is active, it is then determined whether the bow thruster is active or not at step 14.

This control method controls vessel steering by means of an algorithm that utilizes the heading error (the difference between the desired heading and the actual heading) in such a way as to maintain a heading. This algorithm is comprised of the sum of three terms. One term is proportional to the heading error, one term is proportional to the heading error that has accumulated over time, and the last term is proportional to the rate-of-change of the heading error. The result of this summation is used to position the steering device. Each summation term has a multiplier associated with it, which determines that terms' effect on the overall output. These multipliers are often referred to as gains. The first gain is the "P" gain. This is sometimes referred to as rudder gain, since this gain controls how much of the heading error gets applied to the position of the steering device. This term causes the steering device to position itself proportional to the heading error, in the direction that corrects the heading error. The second gain is the "I" gain. This is sometimes referred to as trim, since it effectively adds an offset to the center position of the steering device over time. This eliminates any long-term heading offset due to wind and waves. The third gain is the "D" gain. This is sometimes referred to as counter-rudder. This term causes the steering device to position itself proportional to the rate of turn of the vessel, in the direction that opposes the rate of turn. Other control methods or rules can also be used.

Depending on whether the bow thruster is active or not, different sets of data will be accessed for determining "P", "I" and "D". As shown at steps 16*a* and 16*b*, "P", "I" and "D" will differ based on the engine rpm. That is, since the amount of flow through the nozzle increases as engine rpm increases, it is desirable to make the "P", "I" and "D" factors dependent on engine rpm. While the "P", "I" and "D" factors will generally decrease as engine rpm increases, this may not be the case in some instances, as shown for the "P" factor in step 16*b*. The "P", "I" and "D" factors can also be dependent on vessel speed. For instance, in a low speed docking mode of operation, gain values would generally be set higher to produce sufficiently correcting control of the nozzle. At higher speeds, the gain magnitudes would be set lower since the vessel is more sensitive to changes at the nozzle than at lower speeds. The different curves for each factor can be determined through use of empirical data or through theoretical calculation and can be modified for the dynamics of a specific vessel. The method can take into account other states of the vessel's positioning and propulsing systems, e.g., thruster pushing port, thruster pushing starboard, bucket position, operating mode, and operator's control interface position, all of which are not shown on the logic flow chart.

At step 18, $PtermT_0$, $ItermT_0$ and $DtermT_0$ are calculated based on the "P", "I" and "D" data selected in step 16. $PtermT_0$ is calculated by multiplying "P" by the heading error. $ItermT_0$ is calculated by adding the previous iteration/time period Iterm ($ItermT_{0-1}$) to the factor "I" times Heading Error times ($T_0-T_{0-1}$). $DtermT_0$ is calculated by multiplying "D" times the rate of change of the heading error (determined by comparing the current heading error with the heading error from the previous time period and dividing by ($T_0-T_{0-1}$)). Once these terms have all been calculated, they are summed together at step 20 to arrive at Control $OutT_0$, which is the signal used to control the amount of deflection of the nozzle in the desired direction.

In steps 22 and 24 following step 20, the amount of nozzle deflection and the maximum rate of nozzle deflection indicated by step 20 can be limited based on engine rpm. As engine rpm increases, the effect of the deflection of the nozzle increases. Therefore, these limitations imposed at steps 22 and 24 prevent deflection of the nozzle at too large of an angle or rate of change of angle that might allow the vessel to become unstable or feel unstable to the operator. The signal, whether limited or not in steps 22 and 24 is then output for the control of the nozzle at step 26.

This signal can be a direct signal to the nozzle actuator or can be used to signal another component that controls the nozzle actuator. The cycle then repeats at step 28, returning to the top of the loop. In one embodiment, this cycle repeats approximately 20 times per second but this frequency can be altered as desired.

This control method allows the vessel to be maintained accurately on a desired heading without further input from the vessel operator by adjusting the deflection of the nozzle based on the data selected. It includes limiting factors that prevent heading correction from happening too rapidly that the vessel becomes unstable or the passengers become uncomfortable. This method can be embodied as hardware, software or a combination of the two. It can be incorporated into an existing navigational controller for the vessel or can be a stand alone component. Other thrust vectoring devices can be used, for example, the rudder. One advantage of this method is that the operator doesn't have to fidget with the autopilot interface to adjust sensitivity when changing speed. Also, when tying up the vessel, the operator doesn't have to worry about the vessel twisting in the slip. Nor does the operator have to worry about vessel twisting when activating the bow thruster.

Use of Angular Rate of Turn Sensor and Heading Sensor to Calculate Heading

Another feature of the present invention is a method which uses an angular rate sensor in conjunction with a heading sensor to calculate the current actual heading for display or for use in vessel motion control. The heading sensor can be in the form of 1) a three-axis magnetic heading sensor, occasionally referred to as a strap-down heading sensor, preferably used in conjunction with a pitch and roll sensor as discussed above for error correction; 2) a gimbaled type sensor; 3) a Global Positioning System and/or another type of heading sensor/system.

Figure 2:
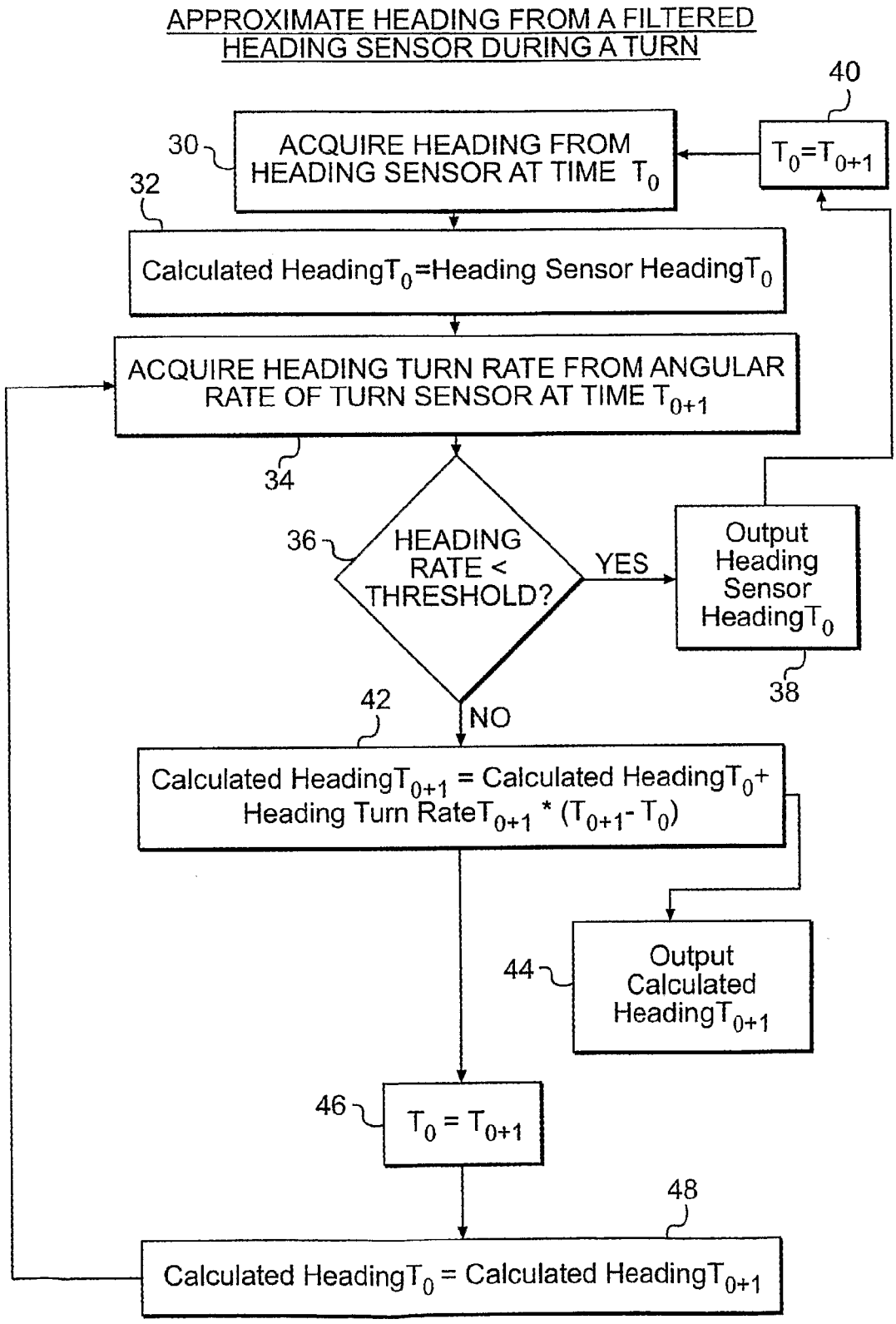
FIG. 2 is a logic flow chart for a second embodiment of the present invention.

Many heading sensors filter their outputs such that during fast maneuvering, the sensor output can lag behind, overshoot, and/or otherwise not reflect the actual heading of the vessel. Global Positioning Systems of a moderate price range may not update rapidly enough or provide the accuracy necessary for precise real-time vessel control. Further, the GPS system may not receive the necessary satellite information to provide the correct data to calculate actual heading. Thus, when the actual heading data used to calculate heading is inaccurate or missing, the current method can compensate for this. The current method uses an angular rate of turn sensor, such as a gyro type sensor, to produce a signal, used in conjunction with the data from the heading sensor, to calculate the actual heading if it is determined that the heading data provided by the heading sensor is not likely to be reflecting the actual heading, or between heading updates (as in a GPS system). As an example of one implementation of this method where the signal from a heading sensor is being filtered and is not reflective of the actual heading, see FIG. 2.

Therefore, until the data from the heading sensor can be trusted again as being accurate, the heading data is calculated using heading turn rate data. In the shown method, the heading is acquired from the heading sensor at time $T_0$, step 30. In the first iteration, the Calculated $HeadingT_0$=Heading Sensor $HeadingT_0$, step 32. The heading turn rate is then acquired from an angular rate of turn sensor at time $T_{0+1}$, step 34. It is then determined whether the heading turn rate is above or below a predetermined threshold at step 36. If it is below the threshold, it is assumed that the turn is not being made so fast that the data from the heading sensor is likely to be inaccurate. Therefore, the heading sensor $headingT_0$ is output to whatever control method or mode needs such data at step 38, the time $T_0$ is reset at step 40 and a new iteration can start at step 30. If the heading turn rate is above the threshold at step 36 such that it is believed that the heading from the heading sensor may be inaccurate, a calculated heading is calculated at step 42 and the calculated heading is output to whatever control method or mode needs such data at step 44. Then, the time $T_0$ is reset at step 46 and a new iteration can start at step 34. When the heading turn rate falls below the predetermined threshold, the calculated heading portion of the loop will be left at step 38 and the process returns to the top of the flow chart, as discussed above.

Figure 3:
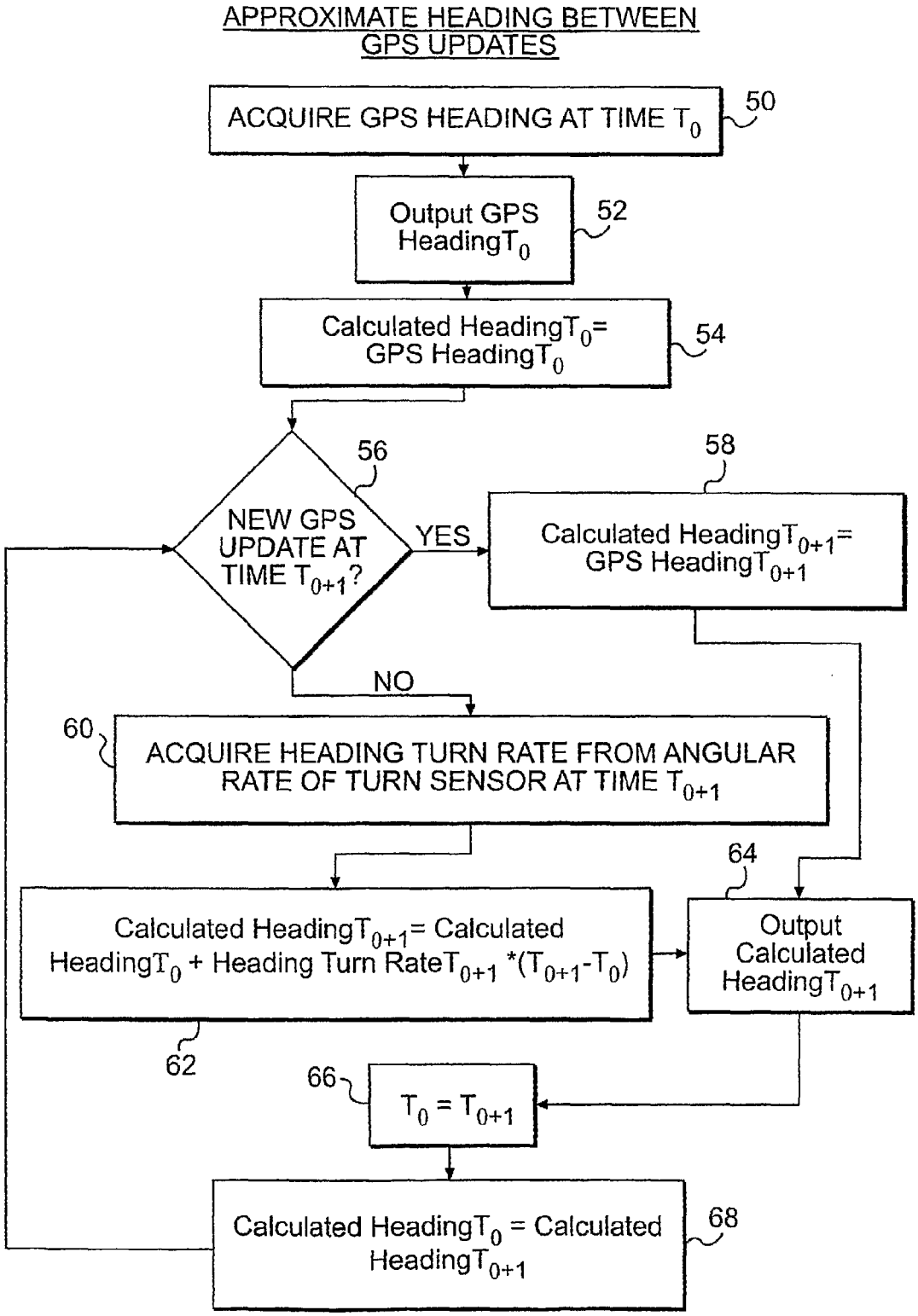
FIG. 3 is a logic flow chart for a third embodiment of the present invention.

A similar method can be used in a system where GPS data is being used to provide heading data. See FIG. 3. Here, the GPS data may not update sufficiently fast to provide the required heading data. Therefore, between updates, the heading data is again calculated using heading turn rate data. In the shown method, the GPS heading is acquired at time $T_0$, step 50. This GPS heading is then output at step 52, and the Calculated $HeadingT_0$ is set to the GPS $HeadingT_0$, step 54. It is then determined whether a new GPS update has been received at time $T_{0+1}$, step 56. If so, the Calculated $HeadingT_{0=1}$ is set to the GPS $HeadingT_{0=1}$ at step 58 and this GPS heading is output at step 64. If no new update has been received, the heading turn rate is acquired from an angular rate of turn sensor at time $T_{0+1}$, step 60. A calculated heading is calculated at step 62 and the calculated heading is output at step 64. Then, the time $T_0$ is reset at step 66, the calculated heading reset at step 68 and the process returns to step 56 to determine whether a new GPS update is available. If not, a new iteration of the bottom loop is performed. If so, the process leaves the bottom loop and returns to the top of the flow chart.

The heading sensor can also be vulnerable to disturbances that affect its output so that the output does not reflect the actual heading. For instance, a magnetic heading sensor is very sensitive to magnetic disturbances that can be caused by operation of equipment on the vessel. Similarly, the gimbaled type sensor can be sensitive to shock or vibration of the vessel, which can affect the accuracy of its output. The existence of such a disturbance can be determined by measurement, such as with a vibration/shock sensor measuring an amount of vibration/shock. The existence of a disturbance can also be assumed when one or more predetermined conditions are met. For instance, in one embodiment, it is assumed that a disturbance is occurring when electrical equipment is operating, thereby causing a magnetic interference with a magnetic heading sensor. The controller can be signaled when such equipment is operating so that it can take corrective action. This method provides a way for correcting the negative effect of the disturbance on the heading data.

Figure 4:
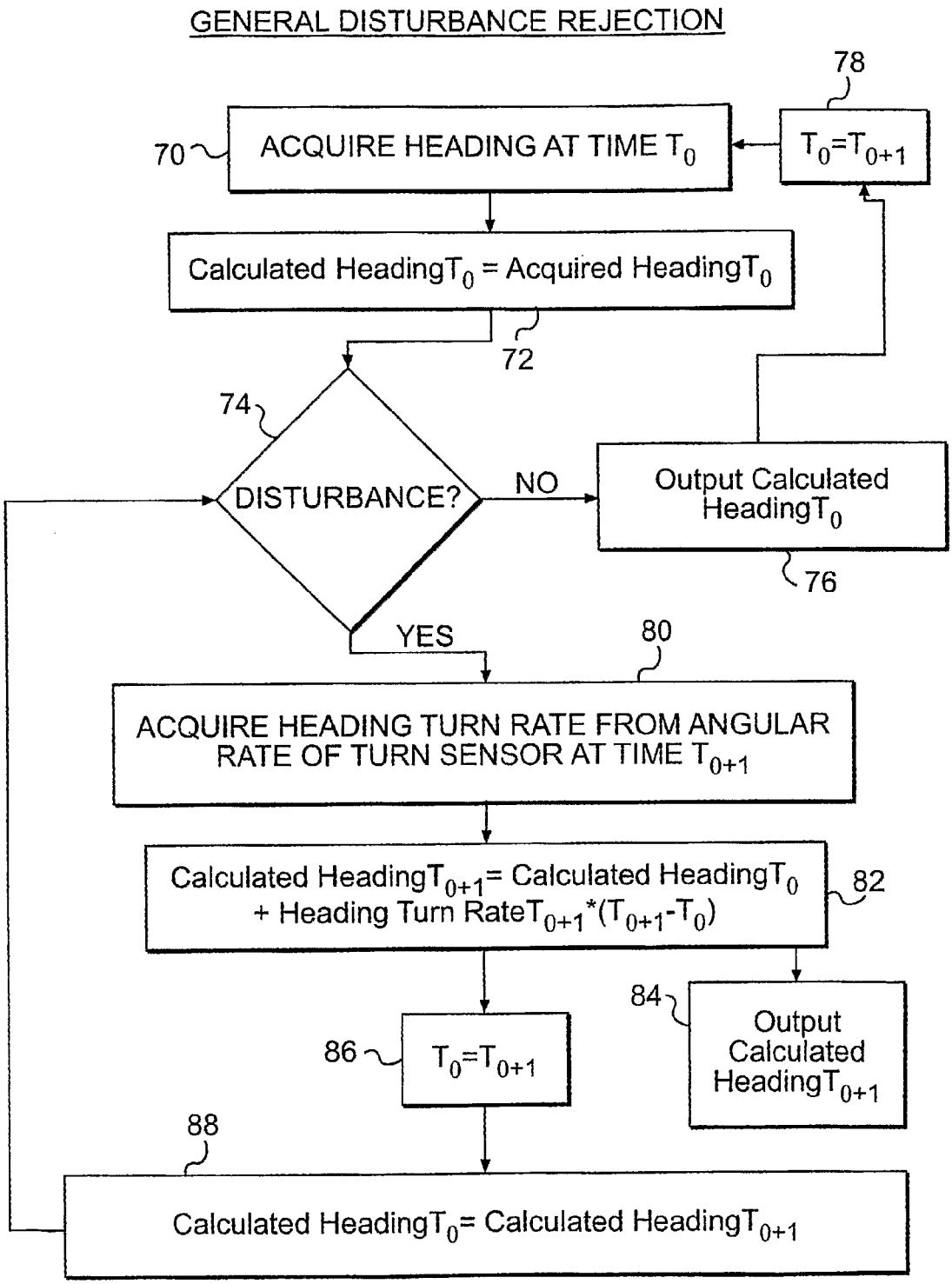
FIG. 4 is a logic flow chart for a fourth embodiment of the present invention.

In one embodiment shown in FIG. 4, a heading is acquired at step 70 and a calculated heading is set to be the acquired heading at step 72. It is then determined whether a disturbance has occurred at step 74. If not, the heading acquired from the heading sensor is assumed to be accurate and is output at step 76. The process then returns to the top of the flow chart. If a disturbance is determined to be occurring so that a newly acquired heading is not believed to be accurate at time $T_{0+1}$, the heading turn rate is acquired from an angular rate of turn sensor at time $T_{0+1}$, step 80. A calculated heading is calculated at step 82 and the calculated heading is output at step 84. Then, the time $T_0$ is reset at step 86, the calculated heading reset at step 88 and the process returns to step 74 to determine whether a disturbance is still occurring. If so, a new iteration of the bottom loop is performed. If not, the process leaves the bottom loop at step 76 and returns to the top of the flow chart. This embodiment can be used for different types of disturbances and different types of heading sensors.

Magnetic disturbances can be dealt with in a specific manner. The magnetic heading sensor is very sensitive to magnetic disturbances that can be caused by operation of equipment on the vessel (such as electric motors, solenoids, thrusters, fish finders and pumps). The discovery of this sensitivity led to the introduction of a rate of turn sensor that is immune to the magnetic disturbances. When interference is anticipated by the method or measured by the magnetic sensor, the controller adjusts the emphasis (weighting) given any effected sensor as required to minimize such magnetic disturbances. In this manner, the controller can preemptively change gains and select the proper sensor based on a priori knowledge or measurement of the disturbances caused by the use of high-EM disturbance devices.

Figure 5:
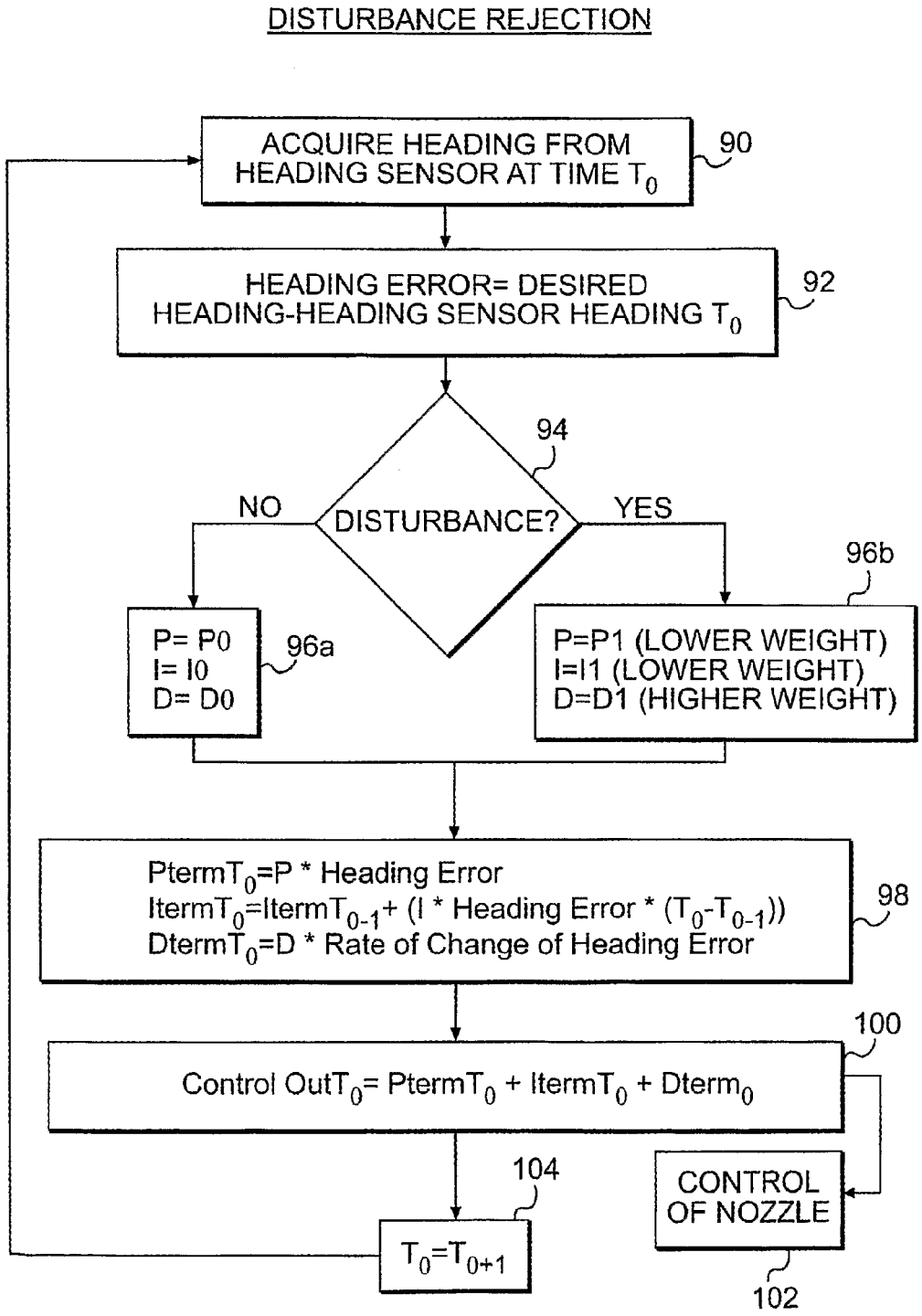
FIG. 5 is a logic flow chart for a fifth embodiment of the present invention.

One embodiment of this method used specifically for magnetic disturbances is shown in FIG. 5. This embodiment is similar to the flow chart in FIG. 1, but where that flow chart determines whether the bow thruster is active, the present flow chart determines whether a magnetic disturbance is occurring. The heading from the heading sensor is acquired at step 90 and a heading error is calculated at step 92. The occurrence of a disturbance is determined at step 94. If no disturbance is present, the "P", "I" and "D" factors are not altered, step 96*a*. If a disturbance is occurring, the "P", "I" and "D" factors are weighted differently in step 96*b* than in step 96*a*. The "D" factor is the derivative factor, proportional to a rate of change of the heading error. It is derived from the rate sensor and not from the magnetic sensor.

It has been found that the weighting for this "D" factor is desirably increased in the presence of a magnetic disturbance, while the weighting for the "P" and "I" factors should be decreased since they are derived from a magnetic source. This is shown at step 96*b*. The Pterm, Iterm and Dterm are then calculated at step 98, the Control Out calculated at step 100 and the resulting signal is used to control the nozzle at step 102, whereupon the time is reset and a new iteration begins. When these magnetic disturbances are transient in nature, such as the activation of a bucket solenoid, they primarily affect the "D" factor discussed above. In the absence of a non-magnetic rate-of-turn sensor, the weighting of this "D" factor can be lowered, and the weighting of the P and I factors raised during a disturbance. Other magnetic and non-magnetic sensors can be used and their relative weighting changed as appropriate.

In situations where the magnetic disturbance is a relatively long-term phenomenon (such as a bow thruster), other terms can be effected. In these cases, when interference is anticipated or measured by the magnetic sensor in a given axis, the controller adds an offset to any effected axis as required to negate such magnetic disturbances. This offset is based on measurement of the disturbances during initial system setup. In some cases (e.g. where only one axis is affected by the disturbance) that axis is calculated from the other two axis measurements. Therefore, the algorithm includes a system programmed to automatically account for any electro-magnetic disturbances.

Figure 6:
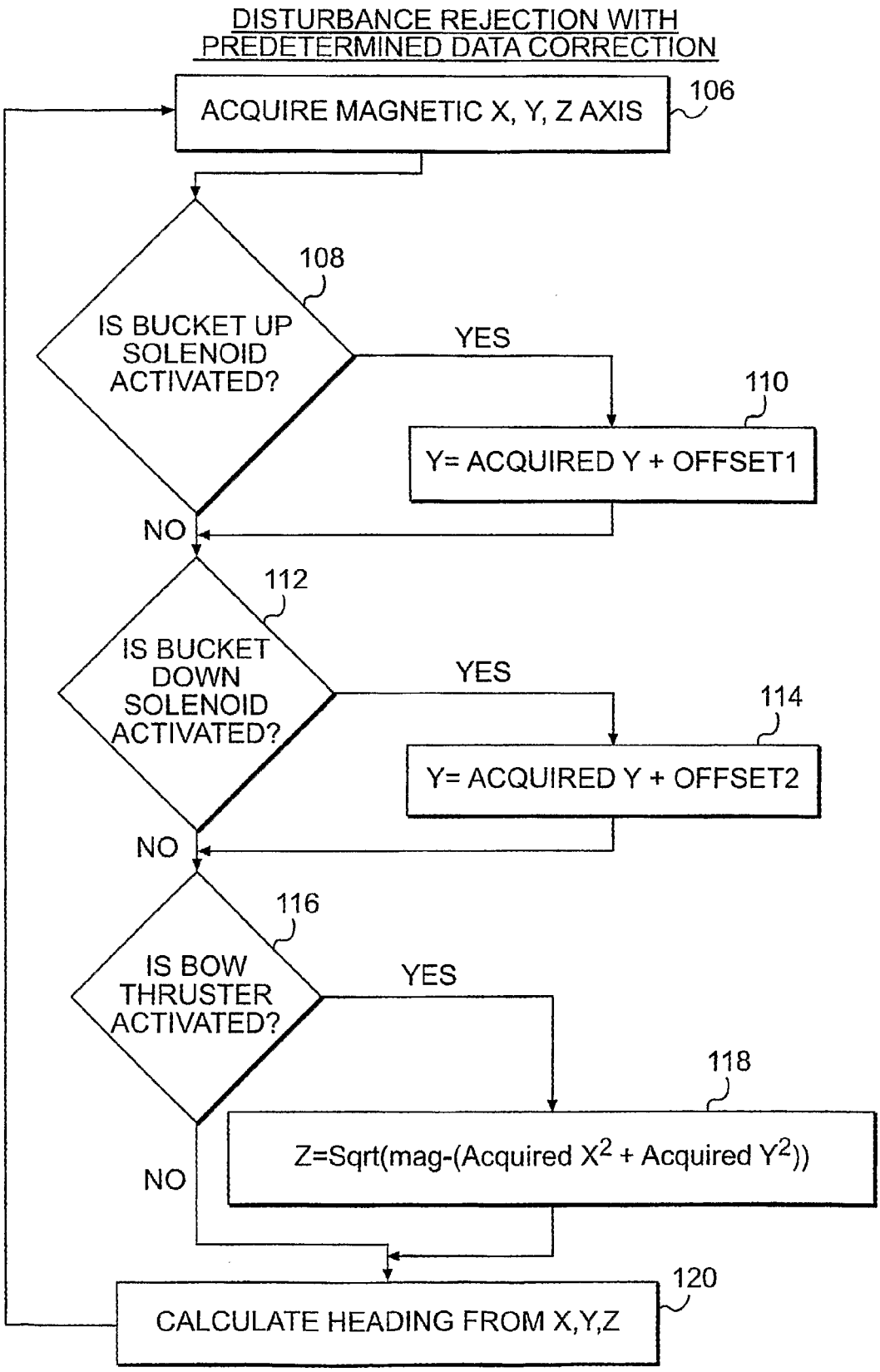
FIG. 6 is a logic flow chart for a sixth embodiment of the present invention.

Another embodiment is shown in FIG. 6. Here, the occurrence of a condition is assumed to create a disturbance and the heading data is corrected based on predetermined knowledge of the effect of such a disturbance on the heading data. The magnetic X, Y and Z data are first acquired at step 106. At step 108, it is determined whether the bucket up solenoid has been activated. If not, the process proceeds to step 112. If so, it has been previously determined, through testing, that a specific error is introduced into the Y axis measurement. Therefore, the Y axis measurement is corrected at step 110 by adding an offset to the acquired Y axis measurement which has previously been determined to offset the effect of the solenoid activation. At step 112, it is determined whether the bucket down solenoid has been activated. If not, the process proceeds to step 116. If so, the Y axis measurement is corrected at step 114. Since the activation of the bucket down solenoid has been determined to affect the Y axis measurement differently than the activation of the bucket up solenoid, a different offset is added to the acquired Y axis measurement at step 114. At step 116, it is determined whether the bow thruster has been activated. If not, the heading can be calculated at step 120 from the acquired X and Z axis measurements and the Y axis measurement, whether acquired from step 106 or corrected at steps 110 or 114. If the bow thruster has been activated, the Z axis measurement is corrected at step 118 by a formula predetermined to best correct for error introduced by the activation of the bow thruster. The heading is then calculated at step 120 with the corrected Z axis measurement. Other disturbances can also be included in this method with corrections to the factors being determined by previous testing, hypothesis and/or measurement.

The various embodiments disclosed herein, and various aspects of such embodiments, can be combined with other embodiments and/or aspects of other embodiments to create new embodiments. A preferred system incorporating the present invention will utilize more than one of the disclosed embodiments.

Using Rate of Turn to Control Roll Out

With control systems known in the field, when the operator wishes to come out of a turn, the steering command is returned to center or neutral and the nozzle automatically deflects to neutral. This results in a delayed roll out (particularly on vessels with low inertia in wind and waves) and usually results in overshoot when a heading-keeping or autopilot feature is available.

In the current invention, when the operator returns the control stick (or other controller) to neutral, commanding the vessel to come out of a turn, the controller senses the vessel's rate of turn during rollout, and optionally before roll out is commenced, and the nozzle is automatically deflected proportional to the rate of turn, to oppose the turn. The nozzle position is continuously updated with the rate of turn throughout the rollout. This results in a quicker, more repeatable response time to end a turn. As the vessel direction straightens (and the vessel stops turning), so does the nozzle so that the vessel and the nozzle meet at the neutral point simultaneously when the vessel completes the turn. In cases where a heading keeping feature is available, the control system then acquires the new heading. Since the vessel is not turning and the nozzle is at neutral, there is no overshoot.

Figure 7:
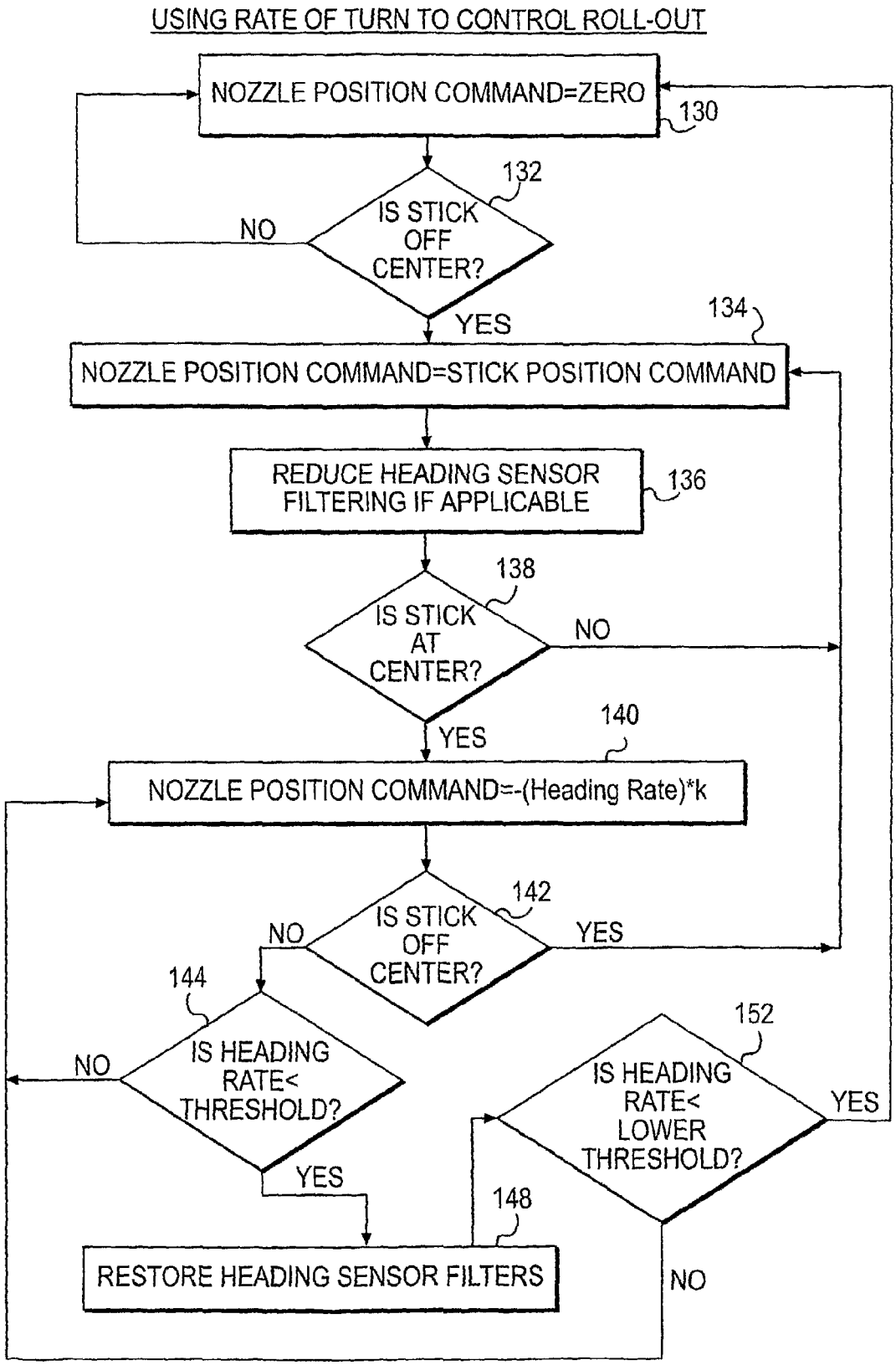
FIG. 7 is a logic flow chart for a seventh embodiment of the present invention.

See FIG. 7 for a logic flow chart of this control method. To begin, the Nozzle Position Command for this control method is zero, step 130. That means that this control method is not altering the nozzle position, whether the nozzle position is neutral or turned. At step 132, it is determined whether the control stick is off-center, that is, the operator is making a turn. If not, the control method returns to step 132. It should be noted, that there are different mechanical controllers for steering the vessel. This can include a joystick system where the joystick is rotated in the desired direction to steer the vessel in that direction and can also include a joystick system where the joystick is moved to the desired side (without rotation) to steer the vessel in the desired direction. Other steering controls can also be used without altering the applicability of this control method, or other control methods discussed herein. Thus, the query as to whether the stick is off-center is merely querying whether the operator is operating the steering control, of whatever type, to steer the vessel.

If the stick is off center, the Nozzle Position Command is set as the Stick Position Command at step 134 so that the nozzle position is directly correlated to the stick position (ignoring adjustments to the nozzle position by other control methods). The Heading Sensor Filtering, if any, is then reduced at step 136 and it is then determined at step 138 whether the stick has returned to center or not. If not, the control method returns to step 134. If the stick is at center, the Nozzle Position Command is set as the negative of the Heading Rate multiplied by a constant factor k. The Heading Rate can be determined from a calculation of the change in heading over time or can come from a Heading Rate Sensor. The constant k can be a specific constant determined for the particular vessel or can be accessed from a chart depending on other factors. It is only at step 140 that this control method actually sends a signal that is used to adjust the position of the nozzle from where it would be if this control method were not in operation.

It is then again determined whether the stick is off center at step 142. If so, for instance, because the operator may be making a slight adjustment to the heading, the control method returns to step 134. If the stick is still at center, it is determined at step 144 whether the Heading Rate is less than a predetermined threshold. Below this threshold, the vessel is turning at a slow enough rate to restore any filtering that was reduced in step 136.

If the Heading Rate is above the threshold, the control method returns to step 140. If the Heading Rate is below the threshold, the Heading Sensor Filters are restored at step 148 and it is determined whether the Heading Rate is below a second, lower threshold at step 152. Here, it is being determined whether the vessel has stopped turning. Although this would indicate that the Heading Rate should be zero, it has been found that because of noise, the Heading Rate may not indicate zero even when the vessel is not turning. Therefore, it is determined whether the Heading Rate is below a threshold that would allow for the noise but still be a good indicator that no turning is occurring or that it is at a very low rate. If below this lower predetermined threshold, it is assumed that the vessel has stopped turning, and the control method returns to the top of the logic flow chart at step 130. If the Heading Rate is above the lower threshold, the vessel may still be turning and the control method returns to step 140.

The controller can also remember the amount of nozzle trim/offset (necessary to maintain a heading) in place before the operator twists the stick, and return the nozzle to that offset as the stick is returned to neutral.

These features result in a quicker, more repeatable response time between when the operator releases the steering device and the final heading achieved after the turn is complete, and overshoot of the final heading is eliminated. They also result in a return to neutral that seems more intuitive to the operator by compensating for factors that the operator might not have a good feel for.

Pre-Positioning Control Elements for Sideways Motion

Known waterjet control systems also have problems when initiating or stopping a sideways translation. For instance, with current autopilot control systems, in both maneuvers, a heading error must first be sensed before the autopilot can respond with a correcting nozzle angle movement.

For instance, when initiating a sideways movement, the bow already has significant sideways momentum by the time the autopilot-initiated nozzle movement occurs. This results in an unanticipated vessel yaw because there is sideways propulsion from the bow thruster at the bow of the vessel but no sideways propulsion yet at the stern of the vessel from the nozzle.

Correspondingly, when sideways movement is underway and the operator wishes to bring the vessel to a stop or change heading, a heading error must first be sensed before the autopilot can respond with a correcting nozzle movement. By the time that autopilot-initiated action occurs, the bow has slowed down significantly and the heavier stern continues moving due to significantly more sideways momentum, again resulting in vessel yaw.

To overcome these control problems, one aspect of the current invention uses pre-emptive, feed-forward (i.e., before heading feedback changes) algorithms that pre-position control elements in anticipation of the heading error that will develop due to the above factors. If sideways movement is being initiated, the nozzle is moved to an appropriate predetermined position that will prevent vessel yaw before heading error can occur and/or the autopilot (or other heading-keeping device) senses the heading error and makes a corresponding adjustment. This repositioning of the nozzle is set to a fixed, predetermined angle based on the characteristics of the vessel and offsets the anticipated yaw. Likewise, when sideways movement is being slowed or stopped, the nozzle is moved to an appropriate predetermined position that will prevent vessel yaw before heading error can occur and/or the autopilot senses the heading error and makes a corresponding adjustment. In the preferred embodiment, the heading-keeping method is used to further adjust the angle of the nozzle to account for conditions such as wind, or water current that may introduce vessel yaw.

Control parameters for these algorithms can be changed as a function of thrust, engine rpm, vessel speed, or control mode.

Time Delay Control to Minimize Vessel Twist

In a vessel with multiple propulsors, i.e., a rear nozzle, and a bow thruster, the vessel responds differently when various types of propulsors are actuated. For instance, with a vessel being propelled sideways by the rear nozzle and a bow thruster, if both propulsors are stopped, the rear of the vessel would tend to drift more than the bow due to the difference in momentum caused by the lighter weight of the bow compared to the stern. Conversely, when initiating a sideways maneuver, the rear takes more time than the bow to gain momentum.

To accommodate the different response times in a way that is unnoticeable to the operator, activation or de-activation of one or more of the propulsors that cause a fast reaction by the vessel is delayed. For instance, when a sideways movement is initiated in a vessel that is heavier in the stern, activation of the bow thruster is delayed for a short time after the rear thruster is activated. This will allow the rear to gain momentum before the bow thruster is activated. The delay time is set so that that the vessel moves sideways in a very intuitive manner.

Similarly, when the operator wishes to end a sideways maneuver, for instance by returning the joystick to the neutral position, the controller will automatically disengage the rear thruster and wait a predetermined time period before disengaging the bow thruster to compensate for the bow slowing down more quickly than the stern. This control method eliminates the vessel's natural tendency to yaw as a result of the difference in momentum between the bow and the stern. The time delay can be changed as a function of thrust, engine rpm, vessel speed, control method, size and weight distribution of the vessel or other factors.

Integration of Autopilot Functions into Vessel Control System

Currently, vessels may employ an autopilot system separate from the electronic controller to control the vessel. The present invention can integrate certain of the autopilot features into the vessel control system by incorporating a heading sensor with the vessel control system. Use of a conventional autopilot (and its associated hardware) is then no longer required. All controls could be on one control handle, making vessel operation easier and more intuitive.

For instance, the following autopilot features can be integrated into the vessel control system:

a. Heading keeping capability, heading setting capability and heading changing capability.
b. Trim/offset necessary to maintain heading can be changed as a function of rate of turn, duration of turn, deflection of nozzle, thrust, change in heading, etc.
c. The trim/offset in place before a sideward maneuver can be restored after the maneuver.
d. Rudder jog capabilities that typically come with an autopilot would be accomplished with the same vessel control stick.
e. Autopilot courses, waypoints, etc. can be obtained by interfacing to a separate device, such as a GPS/Chart plotter having a graphical interface.
f. Heading keeping parameters can be optimized for the given control mode or method. For example, the system can sense when the operator is engaging the bow thruster at low speeds for a sideways movement, and apply the appropriate parameters to the algorithm and filters.

Other aspects which can be integrated into the present invention control system include:

g. Capturing heading as a function of another parameter:
   i. Capture based on heading-rate for smooth, no overshoot, when coming out of turn.
   ii. Capture based as a function of heading-rate sign change or below a threshold for smooth, no overshoot, when coming out of turn.
   iii. Capture as a function of nozzle position for smooth, no overshoot, when coming out of turn.
   iv. Capture heading based on near zero heading rate. Calculations using heading rate at the beginning of a roll-out can be used to display or capture the anticipated heading the vessel will be on at the end of the turn. Heading rate at the beginning of a roll-out can be used to compensate for a lagging heading sensor by determining the time delay before capturing the heading.
h. Applying nozzle, rudder as a non-linear, logarithmic or exponential function of heading-rate (less sensitive to small changes than larger) to minimize over-working and prolong the life of the nozzle actuator/pump/motor. This in lieu of a deadband with a proportional term which linearly varies with rate of heading change (i.e. constant proportional gain).
i. Compensating for electro-magnetic field interference from electronics by compensating for field distortions as a function of mode or lever position, e.g. calculate z-axis magnetic field from x and y, when thruster is activated and offset y axis when bucket solenoids are energized.
j. Compensating for electro-magnetic field interference from electronics by controlling/regulating current (field is proportional to current) as a function of mode or lever position, e.g., offset y-axis when bucket solenoids are energized, offset more when high speed solenoids are energized. The current can be regulated to keep the field constant.
k. Compensating for electro-magnetic field interference from electronics by timing field measurements as a function of mode or lever position e.g. don't measure magnetic field when steering pump changing direction (large current/field transient).
l. Compensate for electro-magnetic field interference from electronics as a function of time unit is energized/de-energized (i.e. wait for field to decay before removing compensation, or even making compensation a function of time while field is decaying). This can also be used for field building-up.
m. Pulse bow thruster proportional to/as a function of stick position. Automatic pulsing of thruster or use of proportional control of motor based on lever position.
n. Adjust nozzle trim/neutral/integral/offset/bias as a function of rpm to compensate for hull dynamics/waterjet outlet. This is changing the neutral steering position as a function of rpm.
o. Determine whether vessel is planing or not, based on vessel pitch and rpm measurements. Automatically change gains according to the vessel conditions.
p. Change operator displays automatically or semi-automatically with mode of control.

These algorithms simplify vessel operation and bring operating characteristics of the vessel closer to the operator's intuition. Also, by automating certain operator functions, the vessel can be controlled more aggressively since less action by the operator is required to effect specific vessel movements. Vessel movements are smoothed by proactively controlling the nozzles based on the operator inputs and not waiting for heading errors to accumulate.

Parameters for the above algorithms (e.g. amount of deflection, constant of proportionality, etc.) can be changed as a function of thrust, engine rpm, vessel speed, control method or mode, weight and size of the vessel, shape of the vessel and other factors. Different of the embodiments can be used together in a control system and various aspects of the different embodiments can be combined in different manners to create different embodiments. The present invention also includes the apparatus with which these control methods are implemented.

What is claimed is:

1. A method for controlling a heading of a watercraft, comprising:

acquiring a desired heading of the watercraft;

acquiring an actual heading of the watercraft at time $T_0$;

calculating a heading error by comparing the desired heading with the actual heading;

determining a rate of change of the heading error:

determining a plurality of algorithm gains, based on the heading error and the heading error rate, to control at least one of an amount and rate of a deflection of a nozzle of the watercraft for use in maintaining the heading of the watercraft;

determining a value for a nozzle control signal by taking into account each determined algorithm gain;

determining an amount of deflection for a nozzle of the watercraft, for altering a heading of the watercraft, based on the value for the nozzle control signal;

deflecting the nozzle based on the determined amount of deflection;

repeating the above steps until the actual heading equals the desired heading.

2. A method as in claim 1, wherein at least one of the amount of deflection of the nozzle and a rate of nozzle deflection is limited based on an RPM of an engine of the watercraft.

3. A method as in claim 1, and further comprising:

determining whether a bow thruster of the watercraft is active;

selecting the algorithm gains from a first set of gain data if the thruster is active and from a second set of gain data if the thruster is not active.

4. A method as in claim 1, and further comprising:

selecting the algorithm gains from various sets of data based on at least one of: engine RPM, watercraft speed, rudder or steering device position, position of a reversing bucket associated with a nozzle of the watercraft, direction of force of a thruster of the watercraft, operating mode of the watercraft and a positioning of an operator's watercraft control interface.

5. A method as in claim 1, and further comprising:

acquiring the actual heading from a heading sensor.

6. A method as in claim 5, wherein the heading sensor is a three axis heading sensor.

7. A method as in claim 6, and further comprising:

measuring a pitch and a roll of the watercraft and using such data to correct a signal from the heading sensor for error due to pitch and roll.

8. A method as in claim 5, and further comprising:

determining whether magnetic disturbance is occurring that can affect the accuracy of the heading from the heading sensor;

selecting the algorithm gains from a first set of gain data if a magnetic disturbance is not occurring and from a second set of gain data if a magnetic occurrence is occurring, wherein the second set of gain data respectively lowers a factor weighting from the gains that are derived from a magnetic source affected by the magnetic disturbance and raises a factor weighting for gains not derived from a magnetic source affected by the magnetic disturbance.

9. A method as in claim 1, wherein the algorithm gains are a P gain, I gain and D gain and the nozzle control signal Control $OutT_0$ is determined by summing the values for $PtermT_0$, $ItermT_0$, and $DtermT_0$; where $PtermT_0$, $ItermT_0$, and $DtermT_0$ are determined using the following equations:

$$PtermT_0 = P^* \text{Heading Error}$$

$$ItermT_0 = ItermT_{0-1} + (I^* \text{Heading Error}^* (T_0 - T_{0-1}))$$

$$DtermT_0 = D^* \text{Rate of Change of Heading Error}$$

wherein P, I and D are the determined P gain, I gain and D gain, respectively;

resetting $T_0$ to $T_{0+1}$ and then repeating the steps until the actual heading equals the desired heading.

10. A method as in claim 9, wherein, if a magnetic occurrence is occurring, the factors for the P gain and I gain are given a lower weight and the factor for the D gain is given a higher weight.

11. A method as in claim 8, wherein, during a continuing magnetic disturbance, an offset is added to an affected axis of a magnetic sensor to negate the magnetic disturbance, the offset based on a predetermined measurement of the affect of the magnetic disturbance on the magnetic sensor.

12. A method as in claim 1, comprising:

determining whether the watercraft is planing, based on watercraft pitch and rpm measurements and adjusting the algorithm gains in such an instance to compensate for the planing.

13. A method as in claim 1, comprising:

deflecting the nozzle based on the determined amount of deflection at all speeds without intervention of a watercraft operator.

14. A method for calculating a heading of a watercraft, comprising:

acquiring a heading of the watercraft at a base time;

acquiring a heading turn rate from an angular rate of turn sensor of the watercraft at a later time;

determining whether the acquired heading is believed accurate at the later time;

if the acquired heading is believed inaccurate, calculating a heading of the watercraft based on the heading turn rate and the originally acquired heading;

outputting the calculated heading for control of the heading of the watercraft.

15. A method as in claim 14, comprising:

acquiring the heading from a heading sensor of the watercraft;

determining whether the acquired heading is believed accurate at the later time by determining whether the heading turn rate exceeds a threshold indicative that the heading from the heading sensor is not accurate.

16. A method as in claim 15, comprising:

repeating the steps from acquiring the heading turn rate for as long as the acquired heading turn rate exceeds the threshold.

17. A method as in claim 16, comprising:

wherein the calculation for the heading equals:

$$\text{Acquired Heading } T_0 + \text{Heading Turn Rate} T_{0+1} * (T_{0+1} - T_0)$$

where $T_0$ is the base time and $T_{0+1}$ is the later time.

18. A method as in claim 15, comprising:

outputting the acquired heading for control of the heading of the watercraft if the heading rate does not exceed the threshold.

19. A method as in claim 18, comprising:

after outputting the acquired heading, acquiring a new heading from the heading sensor and repeating the steps thereafter.

20. A method as in claim 14, comprising:

acquiring the heading of the watercraft from a GPS unit;

determining whether the acquired heading is believed accurate at the later time by determining whether an updated heading from the GPS unit is available at the later time;

calculating the heading of the watercraft based on the heading turn rate and the acquired heading from the GPS unit.

21. A method as in claim 20, comprising:

omitting the step of calculating the heading if an updated heading from the GPS unit is available and outputting such updated heading for control of the heading of the watercraft;

resetting the base time and repeating the steps from acquiring the heading turn rate.

22. A method as in claim 21, comprising:

wherein the calculation for the heading equals:

$$\text{Acquired Heading } T_0 + \text{Heading Turn Rate} T_{0+1} * (T_{0+1} - T_0)$$

where $T_0$ is the base time and $T_{0+1}$ is the later time.

23. A method as in claim 14, comprising:

acquiring the heading from a heading sensor of the watercraft;

determining whether the acquired heading is believed accurate at the later time by determining whether a disturbance has occurred to the heading sensor.

24. A method as in claim 23, comprising:

repeating the steps from acquiring the heading turn rate for as long as the disturbance is occurring.

25. A method as in claim 24, comprising:

wherein the calculation for the heading equals:

$$\text{Acquired Heading } T_0 + \text{Heading Turn Rate} T_{0+1} * (T_{0+1} - T_0)$$

where $T_0$ is the base time and $T_{0+1}$ is the later time.

26. A method as in claim 23, comprising:

outputting the acquired heading for control of the heading of the watercraft if a disturbance to the heading sensor is not occurring.

27. A method as in claim 26, comprising:

after outputting the acquired heading, acquiring a new heading from the heading sensor and repeating the steps thereafter.

28. A method as in claim 23, wherein the heading sensor is a gimbaled type sensor and determining whether a disturbance is occurring is done by measuring for at least one of: vibration and shock.

29. A method for correcting a heading of a watercraft, comprising:

measuring an amount of error induced by the effect of at least one of a magnetic, electrical and vibration/shock disturbance on at least one of x, y and z heading data from a heading sensor;

acquiring at least one of x, y and z heading data from a heading sensor;

determining whether the at least one disturbance is occurring;

correcting the heading data in the occurrence of a disturbance by adding a correction value to the heading that offsets the measured amount of error induced by the disturbance;

outputting the corrected heading data for control of the heading of the watercraft.

30. A method as in claim 29, wherein the at least one disturbance affects one of the x, y and z data and the heading data is corrected by adding the correction value to the affected one of the x, y and z data.

31. A method as in claim 30, wherein the at least one disturbance affects at least two of the x, y and z data and the heading data is corrected by adding the correction value to the affected two of the x, y and z data.

32. A method as in claim 30, comprising:

determining the correction value based on at least one axis that is not disturbed by the disturbance.

33. A method as in claim 30, wherein the heading sensor is a magnetic heading sensor and the disturbance is at least one of: operating a bow thruster of the watercraft, operating a reversing bucket of the watercraft, and operating other electrical equipment of the watercraft.

34. A method for controlling roll out of a watercraft, comprising:

determining whether a steering apparatus is off center to alter a position of a nozzle of the watercraft;

if the steering apparatus is off center, setting a nozzle position command to a steering command from the steering apparatus;

determining whether the steering apparatus has been returned to a center position;

if the steering apparatus has been returned to a center position, setting the nozzle position command to oppose a turn of the watercraft.

35. A method as in claim 34, wherein if the steering apparatus has been returned to a center position, setting the nozzle position command to a position predetermined for the watercraft based on operating data of the watercraft.

36. A method as in claim 35, comprising:

determining a heading rate for the watercraft;

if the steering apparatus has been returned to a center position, setting a nozzle position command to a negative of the heading rate multiplied by a constant factor predetermined for the watercraft based on operating data of the watercraft.

37. A method as in claim 36, and further comprising;

after the setting of the nozzle position command to the negative of the heading rate multiplied by the constant factor, determining whether the steering apparatus has been positioned to off center and if so, repeating the steps from setting the nozzle position command to the steering command.

38. A method as in claim 36, and further comprising:

after the setting of the nozzle position command to the negative of the heading rate multiplied by the constant factor, determining whether the nozzle position apparatus is still in the center position, and if so, determining whether the heading rate is below a first predetermined threshold indicating that turning of the watercraft has essentially stopped;

if the heading rate is not below the first predetermined threshold, returning to the step of setting of the nozzle position command to the negative of the heading rate multiplied by the constant factor and repeating the steps thereafter.

39. A method as in claim 38, and further comprising:

if the heading rate is below the first predetermined threshold, returning to the first step of determining whether the steering apparatus is off center and repeating the steps thereafter.

40. A method as in claim 38, and further comprising:

reducing any heading sensor filtering prior to determining whether the steering apparatus has returned to center;

after determining whether the heading rate is below the first predetermined threshold, restoring the heading sensor filtering and then if the heading rate is below a second predetermined threshold, lower than the first predetermined threshold, indicating that turning of the watercraft has essentially stopped based on filtered heading sensor data, with the first predetermined threshold being based on unfiltered heading sensor data, returning to the first step of determining whether the steering apparatus is off center and repeating the steps thereafter.

41. A method as in claim 38, and further comprising:

changing heading sensor filtering as a function of a heading rate.

42. A method as in claim 34, wherein the steering apparatus is a joystick control.

43. A method as in claim 38, wherein the steering apparatus is a joystick control.

44. A method for controlling a watercraft having a rear propulsion device and a thruster, comprising:

during at least one of initiation and cessation of sideways movement of the watercraft by engagement/disengagement of the thruster, prepositioning an angle of the rear propulsion device to provide a sideways force that minimizes vessel yaw prior to the occurrence of a heading error, the prepositioned angle based on operating characteristics of the watercraft.

45. A method as in claim 44, wherein the rear propulsion device is prepositioned to a first angle for the initiation of a sideways movement and prepositioned to a counterpart second angle for the cessation of sideways movement.

46. A method as in claim 45, wherein the prepositioned angles are based on at least one of; nozzle thrust, engine speed, watercraft speed and a control mode of the watercraft.

47. A method as in claim 44, wherein the rear propulsion device is a rear nozzle.

48. A method for controlling a watercraft having a rear propulsion device and a thruster, comprising:

initiating a sideways movement of the watercraft by engaging the rear propulsion device while delaying engagement of the thruster;

engaging the thruster after a first predetermined time delay to assist in the sideways movement of the watercraft after a stern of the watercraft has gained sideways momentum from the rear propulsion device, the first predetermined time delay based on operating characteristics of the watercraft to minimize yaw of the watercraft during the sideways movement.

49. A method as in claim 48, and further comprising, ending the sideways movement of the watercraft by disengaging the rear propulsion device of the watercraft and disengaging the thruster after a second predetermined time delay after disengaging the rear propulsion device to allow sideways momentum of the stern of the watercraft to dissipate before disengagement of the thruster, the second predetermined time delay based on the operating characteristics of the watercraft to minimize yaw of the watercraft during cessation of the sideways movement.

50. A method as in claim 48, wherein the rear propulsion device is a rear nozzle.

51. A method as in claim 49, wherein the first predetermined time delay and the second predetermined time delay are substantially the same.

52. A method for compensating for disturbances of a magnetic heading sensor of a watercraft, comprising:

reducing an effect of electro-magnetic field interference from electrical equipment of the watercraft on an accuracy of a heading signal from the magnetic heading sensor by at least one of: 1) compensating for the field interference based on at least one of a) a function mode of the watercraft and b) a position of a vessel movement control apparatus and 2) acquiring the heading signal only when electro-magnetic interference is sufficiently low to prevent substantive inaccuracy of heading data.

53. A method as in claim 52, comprising;

offsetting one of an x axis signal and a y axis signal from the magnetic sensor an amount proportional to a value of a current draw of interference inducing electrical equipment.

54. A method as in claim 53, comprising;

regulating a current draw of the interference inducing equipment to maintain a substantively constant electro magnetic field.

55. A method as in claim 53, comprising;

offsetting the heading signal for a predetermined time after deactivation of the interference inducing equipment to allow the interference field to decay before the signal offset is removed.

56. A method as in claim 52, comprising;

delaying acquiring the heading signal after deactivating operation of interference inducing equipment by a time sufficient to allow the interference field to decay to a non-substantive level.

57. A method as in claim 1, wherein a trim/offset of the watercraft in place before a maneuver is restored after the maneuver.

58. A method as in claim 44, wherein a trim/offset of the watercraft in place before a sideways maneuver is restored after the maneuver.

59. A method as in claim 48, wherein a trim/offset of the watercraft in place before a sideways maneuver is restored after the maneuver.

* * * * *